US006477926B1

(12) United States Patent
Swisher et al.

(10) Patent No.: US 6,477,926 B1
(45) Date of Patent: Nov. 12, 2002

(54) POLISHING PAD

(75) Inventors: Robert G. Swisher, Pittsburgh, PA (US); Alan E. Wang, Gibsonia, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 55 days.

(21) Appl. No.: 09/663,180

(22) Filed: Sep. 15, 2000

(51) Int. Cl.[7] ..... B24D 11/00
(52) U.S. Cl. ..... 81/526; 51/296
(58) Field of Search ..... 451/526, 527, 451/530, 532, 539, 41; 51/295, 296, 297, 298, 309, 307, 293

(56) References Cited

U.S. PATENT DOCUMENTS

| | | | | |
|---|---|---|---|---|
| 3,763,054 A | | 10/1973 | Reischl et al. | 521/69 |
| 4,576,612 A | * | 3/1986 | Shukla et al. | 451/526 |
| 4,880,843 A | | 11/1989 | Stein | |
| 4,893,439 A | * | 1/1990 | McAvoy et al. | 451/533 |
| 5,282,900 A | * | 2/1994 | McDonell et al. | 51/295 |
| 5,549,961 A | * | 8/1996 | Haas et al. | 51/295 |
| 5,578,362 A | | 11/1996 | Reinhardt et al. | |
| 5,631,339 A | | 5/1997 | Faler et al. | |
| 5,667,842 A | * | 9/1997 | Larson et al. | 51/295 |
| 5,693,738 A | | 12/1997 | Okazaki et al. | |
| 5,876,470 A | * | 3/1999 | Abrahamson | 51/309 |
| 5,900,164 A | | 5/1999 | Budinger et al. | |
| 5,924,917 A | * | 7/1999 | Benedict et al. | 451/526 |
| 5,976,000 A | | 11/1999 | Hudson | |
| 6,022,268 A | | 2/2000 | Roberts et al. | |
| 6,117,000 A | * | 9/2000 | Anjur et al. | 451/526 |
| 6,120,353 A | * | 9/2000 | Suzuki et al. | 451/526 |
| 6,126,532 A | * | 10/2000 | Sevilla et al. | 451/526 |
| 6,155,910 A | * | 12/2000 | Lamphere et al. | 451/527 |
| 6,312,484 B1 | * | 11/2001 | Chou et al. | 51/298 |
| 6,174,227 B1 | * | 1/2002 | Ishikawa | 451/526 |

FOREIGN PATENT DOCUMENTS

| | | |
|---|---|---|
| GB | 2334205 A | 8/1999 |
| WO | WO 96/15887 | 5/1996 |
| WO | WO 98/45087 | 10/1998 |
| WO | WO 98/47662 | 10/1998 |
| WO | WO 99/07515 | 2/1999 |

OTHER PUBLICATIONS

U.S. application Ser. No. 09/663,880, filed Sep. 15, 2000, Group Art Unit 1713, "Method of Preparing Particulate Crosslinked Polymer", Robert G. Swisher and Alan E. Wang.

American Standard Test Method (ASTM) No. D–1622–88, "Standard Test Method for Apparent Density of Rigid Cellular Plastics".

* cited by examiner

*Primary Examiner*—Eileen P. Morgan
*Assistant Examiner*—Hadi Shakeri
(74) *Attorney, Agent, or Firm*—Carol A. Marmo; James R. Franks

(57) ABSTRACT

A polishing pad is described as comprising, (a) particulate polymer selected from particulate thermoplastic polymer (e.g., particulate thermoplastic polyurethane), particulate crosslinked polymer (e.g., particulate crosslinked polyurethane and/or particulate crosslinked polyepoxide) and mixtures thereof; and (b) crosslinked organic polymer binder (e.g., crosslinked polyurethane binder and/or crosslinked polyepoxide binder), which binds the particulate polymer together. The particulate polymer and crosslinked organic polymer binder are distributed substantially uniformly throughout the polishing pad, and the pad has a percent pore volume of from 2 percent by volume to 50 percent by volume, based on the total volume of said polishing pad. Polishing pad assemblies are also described.

27 Claims, 1 Drawing Sheet

POLISHING PAD

DESCRIPTION OF THE INVENTION

The present invention relates to polishing pads. In particular, the polishing pads of the present invention are porous and composed of particulate polymer, e.g., particulate crosslinked polymer, and crosslinked organic polymer binder that binds the particulate polymer together. Polishing pads according to the present invention are useful for polishing articles, e.g., the chemical mechanical polishing or planarization of semiconductor substrates.

The polishing or planarization of the rough surface of an article, e.g., a semiconductor substrate, to a smooth surface generally involves rubbing the rough surface with the work surface of a polishing pad using a controlled and repetitive motion. Typically, a polishing fluid is interposed between the rough surface of the article that is to be polished and the work surface of the polishing pad. The polishing fluid may optionally contain an abrasive material, e.g., particulate cerium oxide.

The fabrication of semiconductor wafers typically involves the formation of a plurality of integrated circuits on a semiconductor substrate of, for example, silicon or gallium arsenide. The integrated circuits are generally formed by means of a series of process steps in which patterned layers of materials, such as conductive, insulating and semiconducting materials, are formed on the substrate. In order to maximize the density of integrated circuits per wafer, it is necessary to have an extremely planar precision polished substrate at various stages throughout the semiconductor wafer production process. As such, semiconductor wafer production typically involves at least one, and more typically a plurality of polishing steps, which involve the use of one or more polishing pads.

The polishing steps typically involve rotating the polishing pad and/or semiconductor wafer substrate against each other in the presence of a polishing fluid. The polishing fluid is often mildly alkaline and may optionally contain abrasive particulate materials, e.g., silica. The pad acts to mechanically polish the semiconductor substrate, while the polishing fluid serves to chemically polish the substrate and to facilitate the removal and transport of abraded material off of and away from the rough surface of the article.

The pressure at which the polishing pad and substrate are pressed against each other, and the rate at which they are turned against each other is generally maintained within high tolerances to ensure a controlled rate of substrate removal. Unfortunately, polishing and planarization characteristics are often variable from pad-to-pad, and throughout the operating lifetime of a given pad (i.e., intrapad variability). Correspondingly, variations in the polishing characteristics of the pads typically results in inadequately polished and planarized substrates, which may have to be scrapped. Physical properties of polishing pads that can result in variable polishing characteristics include, for example, variations in pore volume and pore size from one pad to the next, and within a single pad.

It is desirable to develop polishing pads that exhibit reduced and preferably minimal pad-to-pad variation in polishing and planarization characteristics. It is further desirable to develop polishing pads that exhibit reduced and preferably minimal variations in polishing and planarization characteristics throughout the operating lifetime of the pad.

International Publication No. WO 98/47662, published under the Patent Cooperation Treaty, describes a polishing pad for semiconductor substrates, which is fabricated from sintered particles of thermoplastic resin. The polishing pads of International Publication No. WO 98/47662 are further described as being porous and uniform.

International Publication No. WO 96/15887, published under the Patent Cooperation Treaty, describes polishing pads prepared by pressure sintering powder compacts of thermoplastic polymer at temperatures above the glass transition temperature but not exceeding the melting point of the thermoplastic polymer. The polishing pads of International Publication No. WO 96/15887 are further described as having interconnected porosity, which is uniform in all directions.

U.S. Pat. Nos. 5,900,164 and 5,578,362 describe polymeric polishing pads, which include a polymeric matrix impregnated with a plurality of polymeric microelements, wherein each polymeric microelement has a void space therein. The '164 and '362 patents further describe the polymeric microelements at the work surface of the polishing pad as becoming softer than those microelements embedded in the subsurface of the pad, when the work surface is in contact with a working environment.

In accordance with the present invention, there is provided a polishing pad comprising:

(a) particulate polymer selected from particulate thermoplastic polymer, particulate crosslinked polymer and mixtures thereof; and (b) crosslinked organic polymer binder, which binds said particulate polymer together, wherein said particulate polymer and said crosslinked organic polymer binder are distributed substantially uniformly throughout said pad, and said pad has a percent pore volume of from 2 percent by volume to 50 percent by volume, based on the total volume of said polishing pad (e.g., from 5 percent by volume to 40 percent by volume, or from 10 percent by volume to 30 percent by volume, based on the total volume of the polishing pad). The percent pore volume of the polishing pad is calculated using the following equation, $$100\times(\text{density of the pad})\times(\text{pore volume of the pad})$$

wherein the density is determined in accordance with American Standard Test Method (ASTM) No. D 1622-88, and the pore volume is determined by means of the art-recognized mercury porosimitry method, as describe further herein in the Examples.

The features that characterize the present invention are pointed out with particularity in the claims, which are annexed to and form a part of this disclosure. These and other features of the invention, its operating advantages and the specific objects obtained by its use will be more fully understood from the following detailed description and the accompanying drawings in which embodiments of the invention are illustrated and described.

Other than in the operating examples, or where otherwise indicated, all numbers or expressions, such as those expressing structural dimensions, pressures, flow rates, etc, used in the specification and claims are to be understood as modified in all instances by the term "about."

BRIEF DESCRIPTION OF THE DRAWINGS

FIGS. 1–3 are not to scale. In FIGS. 1–3, like numerals refer to the same structural components.

DETAILED DESCRIPTION OF THE INVENTION

Figure 1:
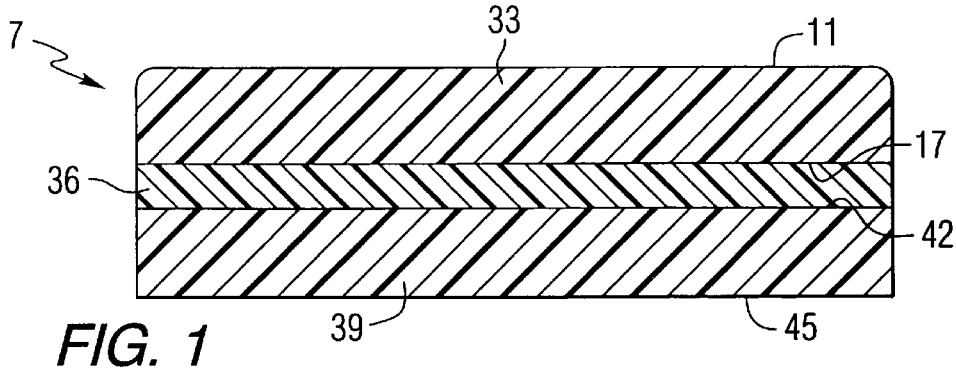
FIG. 1 is a sectional representation of a polishing pad assembly according to the present invention.

The crosslinked organic polymer binder (b) of polishing pads according to the present invention, binds the particulate polymer (a) together in the pad. While not intending to be bound by any theory, and based on the evidence at hand, it is believed that there is minimal to no sintering, e.g., melt sintering, between the particles of the particulate polymer in polishing pads according to the present invention. When the particulate polymer of the pad comprises particulate thermoplastic polymer, the polishing pad is prepared below the melting or sintering point of the particulate thermoplastic polymer, as will be discussed further herein. Particulate crosslinked polymers as defined herein, do not have a melting or sintering point, and correspondingly are not sinterable.

The particulate polymer of the polishing pad may be prepared by methods that are known to the skilled artisan. For example, bulk thermoplastic polymers and bulk crosslinked polymers may each be cryogenically ground and classified into desired particle size ranges. In an embodiment of the present invention, the particulate crosslinked polymer is prepared directly by reacting a two-component composition in the presence of a heated and agitated liquid medium in which the two-component composition is substantially insoluble, e.g., an aqueous medium (as will be discussed further herein). The shape of the particulate polymer may be regular and/or irregular, and may be selected from shapes including, for example, spherical, disk, flake and combinations and/or mixtures thereof.

The particulate polymer of the polishing pad typically has an average particle size of at least 20 microns, preferably at least 50 microns, and more preferably at least 100 microns. The particulate polymer typically has an average particle size of less than 500 microns, preferably less than 400 microns, and more preferably less than 300 microns. The average particle size of the particulate polymer may range between any combination of these upper and lower amounts, inclusive of the recited values. The average particle size of the particulate polymer may be determined by methods that are well known to the skilled artisan, e.g., using analytical instrumentation, such as a Coulter LS particle size analyzer.

In an embodiment of the present invention, the particulate polymer is substantially solid. As used herein and in the claims, and with reference to the particulate polymer of the polishing pad, by "substantially solid" is meant that the particulate polymer is not hollow, e.g., it is not in the form hollow microcapsules. While the substantially solid particulate polymer may contain entrapped gas, the entrapped gas bubbles have an average diameter that is typically less than half the average diameter of the particulate polymer.

The particulate polymer of the polishing pad of the present invention may be selected from particulate thermoplastic polymer. As used herein and in the claims, by "thermoplastic polymer" is meant a polymeric material that softens or melts when heated above its softening or melting point, and returns to its original condition when cooled below its softening or melting point. The particulate thermoplastic polymer may be selected from those thermoplastics that are well known to the skilled artisan, for example, polyvinylchloride, polyvinylfluoride, polyethylene, polypropylene, nylon, polycarbonate, polyester, poly(meth) acrylate, polyether, polyamide, polyurethane, polystyrene, polyimide (e.g., polyetherimide), polysulfone and mixtures thereof. As used herein and in the claims, the term "(meth) acrylate" and similar terms refers to acrylates, methacrylates and combinations of acrylates and methacrylates.

In an embodiment of the present invention, the particulate thermoplastic polymer is selected from thermoplastic poly (meth)acrylate, thermoplastic polyurethane and mixtures thereof. Thermoplastic polyurethane polymers from which the particulate thermoplastic polymer may be selected include, for example, TEXIN® aliphatic polyether-based thermoplastic polyurethane resins, which are available commercially from Bayer Corporation. Examples of thermoplastic poly(meth)acrylates from which the particulate thermoplastic polymer may be selected include, ROHADON thermoplastic poly(meth)acrylate, available from RÖHM America, Inc.

The particulate polymer of the polishing pad may be selected from particulate crosslinked polymers. As used herein and in the claims, the term "crosslinked polymer" refers to polymers that have a three-dimensional crosslink network and that do not have a melting or sintering point. Accordingly, the particulate crosslinked polymers of the present invention do not become sintered together upon heating.

The particulate crosslinked polymer may be selected from particulate crosslinked polyurethane, particulate crosslinked polyepoxide and mixtures thereof. As used herein and in the claims, the term "crosslinked polyurethane" with regard to the particulate crosslinked polymer (a) and the crosslinked organic polymer binder (b), refers to crosslinked polymers that are prepared from an isocyanate functional reactant and an active hydrogen functional reactant. Crosslinked polyurethanes typically have backbone linkages selected from urethane linkages (—NH—C(O)—O—), urea linkages (—NH—C(O)—NH— or —NH—C(O)—N(R)— wherein R is hydrogen, an aliphatic, cycloaliphatic or aromatic group) and combinations thereof. The term "crosslinked polyepoxide" as used herein and in the claims, and with regard to the particulate crosslinked polymer (a) and the crosslinked organic polymer binder (b), refers to crosslinked polymers that are prepared from an epoxide functional reactant and an active hydrogen functional reactant. Crosslinked polyepoxides typically have backbone linkages selected from ether linkages, ester linkages, amino linkages and combinations thereof.

Particulate crosslinked polyurethanes may be prepared according to methods that are well known to the skilled artisan. Typically, the particulate crosslinked polyurethane is prepared from a two-component composition comprising: (i) an isocyanate functional first component comprising an isocyanate functional reactant having at least two isocyanate groups, and optionally a capped isocyanate reactant having at least two capped isocyanate groups; and (ii) an active hydrogen functional second component comprising an active hydrogen functional reactant having at least two active hydrogen groups that are reactive with the isocyanate groups of the isocyanate component.

The first and second components of the two-component composition used to prepare the particulate crosslinked polyurethane may be mixed together and polymerized or cured to form bulk crosslinked polyurethane, which is then ground, e.g., cryogenically ground, and optionally classified. Alternatively, the particulate crosslinked polyurethane may be formed directly by mixing the first and second components together, pouring the mixture slowly into heated deionized water under agitation (in the optional presence of organic cosolvent and/or surfactant), isolating the formed particulate material, e.g., by filtration, drying the isolated particulate material, and optionally classifying the dried particulate crosslinked polyurethane. The first and second components may be optionally mixed together in the presence of an organic solvent, such as a ketone, e.g., methyl isobutyl kentone.

The isocyanate functional reactant of the first component (i) of the two-component composition used to prepare the particulate crosslinked polyurethane, may be selected from isocyanate functional monomers, isocyanate functional prepolymers and combinations thereof. Classes of isocyanate monomers that may be used to prepare the particulate crosslinked polyurethane include, but are not limited to, aliphatic polyisocyanates; ethylenically unsaturated polyisocyanates; alicyclic polyisocyanates; aromatic polyisocyanates wherein the isocyanate groups are not bonded directly to the aromatic ring, e.g., α,α'-xylene diisocyanate; aromatic polyisocyanates wherein the isocyanate groups are bonded directly to the aromatic ring, e.g., benzene diisocyanate; halogenated, alkylated, alkoxylated, nitrated, carbodiimide modified, urea modified and biuret modified derivatives of polyisocyanates belonging to these classes; and dimerized and trimerized products of polyisocyanates belonging to these classes.

Examples of aliphatic polyisocyanates from which the isocyanate functional reactant may be selected include, but are not limited to, ethylene diisocyanate, trimethylene diisocyanate, tetramethylene diisocyanate, hexamethylene diisocyanate, octamethylene diisocyanate, nonamethylene diisocyanate, 2,2'-dimethylpentane diisocyanate, 2,2,4-trimethylhexane diisocyanate, decamethylene diisocyanate, 2,4,4,-trimethylhexamethylene diisocyanate, 1,6,11-undecanetriisocyanate, 1,3,6-hexamethylene triisocyanate, 1,8-diisocyanato-4-(isocyanatomethyl)octane, 2,5,7-trimethyl-1,8-diisocyanato-5-(isocyanatomethyl)octane, bis(isocyanatoethyl)-carbonate, bis(isocyanatoethyl)ether, 2-isocyanatopropyl-2,6-diisocyanatohexanoate, lysinediisocyanate methyl ester and lysinetriisocyanate methyl ester.

Examples of ethylenically unsaturated polyisocyanates from which the isocyanate functional reactant may be selected include, but are not limited to, butene diisocyanate and 1,3-butadiene-1,4-diisocyanate. Alicyclic polyisocyanates from which the isocyanate functional reactant may be selected include, but are not limited to, isophorone diisocyanate, cyclohexane diisocyanate, methylcyclohexane diisocyanate, bis(isocyanatomethyl)cyclohexane, bis(isocyanatocyclohexyl)methane, bis(isocyanatocyclohexyl)-2,2-propane, bis(isocyanatocyclohexyl)-1,2-ethane, 2-isocyanatomethyl-3-(3-isocyanatopropyl)-5-isocyanatomethyl-bicyclo[2.2.1]-heptane, 2-isocyanatomethyl-3-(3-isocyanatopropyl)-6-isocyanatomethyl-bicyclo[2.2.1]-heptane, 2-isocyanatomethyl-2-(3-isocyanatopropyl)-5-isocyanatomethyl-bicyclo[2.2.1]-heptane, 2-isocyanatomethyl-2-(3-isocyanatopropyl)-6-isocyanatomethyl-bicyclo[2.2.1]-heptane, 2-isocyanatomethyl-3-(3-isocyanatopropyl)-6-(2-isocyanatoethyl)-bicyclo[2.2.1]-heptane, 2-isocyanatomethyl-2-(3-isocyanatopropyl)-5-(2-isocyanatoethyl)-bicyclo[2.2.1]-heptane and 2-isocyanatomethyl-2-(3-isocyanatopropyl)-6-(2-isocyanatoethyl)-bicyclo[2.2.1]-heptane.

Examples of aromatic polyisocyanates wherein the isocyanate groups are not bonded directly to the aromatic ring from which the isocyanate functional reactant may be selected include, but are not limited to, bis(isocyanatoethyl) benzene, α,α,α',α'-tetramethylxylene diisocyanate, 1,3-bis(1-isocyanato-1-methylethyl)benzene, bis(isocyanatobutyl) benzene, bis(isocyanatomethyl)naphthalene, bis(isocyanatomethyl)diphenyl ether, bis(isocyanatoethyl) phthalate, mesitylene triisocyanate and 2,5-di(isocyanatomethyl)furan. Aromatic polyisocyanates, having isocyanate groups bonded directly to the aromatic ring, from which the isocyanate functional reactant may be selected include, but are not limited to, phenylene diisocyanate, ethylphenylene diisocyanate, isopropylphenylene diisocyanate, dimethylphenylene diisocyanate, diethylphenylene diisocyanate, diisopropylphenylene diisocyanate, trimethylbenzene triisocyanate, benzene triisocyanate, naphthalene diisocyanate, methylnaphthalene diisocyanate, biphenyl diisocyanate, ortho-tolidine diisocyanate, 4,4'-diphenylmethane diisocyanate, bis(3-methyl-4-isocyanatophenyl)methane, bis(isocyanatophenyl)ethylene, 3,3'-dimethoxy-biphenyl-4,4'-diisocyanate, triphenylmethane triisocyanate, polymeric 4,4'-diphenylmethane diisocyanate, naphthalene triisocyanate, diphenylmethane-2,4,4'-triisocyanate, 4-methyldiphenylmethane-3,5,2',4',6'-pentaisocyanate, diphenylether diisocyanate, bis(isocyanatophenylether)ethyleneglycol, bis(isocyanatophenylether)-1,3-propyleneglycol, benzophenone diisocyanate, carbazole diisocyanate, ethylcarbazole diisocyanate and dichlorocarbazole diisocyanate.

In an embodiment of the present invention, the isocyanate functional reactant of the first component (i) of the two-component composition used to prepare the particulate crosslinked polyurethane is a polyisocyanate monomer having two isocyanate groups. Examples of preferred polyisocyanate monomers having two isocyanate groups include, α,α'-xylene diisocyanate, α,α,α,α'-tetramethylxylene diisocyanate, isophorone diisocyanate, bis(isocyanatocyclohexyl)methane, toluene diisocyanate, 4,4'-diphenylmethane diisocyanate and mixtures thereof.

The first component of the two-component composition used to prepare the particulate crosslinked polyurethane may also comprise an isocyanate functional polyurethane prepolymer. Isocyanate functional polyurethane prepolymers may be prepared according to methods that are well known to the skilled artisan. Typically, at least one polyol, e.g., a diol, and at least one isocyanate functional monomer, e.g., a diisocyanate monomer, are reacted together to form a polyurethane prepolymer having at least two isocyanate groups. Examples of isocyanate functional monomers that may be used to prepare the isocyanate functional polyurethane prepolymer, include those classes and examples of isocyanate functional monomers as recited previously herein. The molecular weight of the isocyanate functional polyurethane prepolymer can vary widely, for example, having a number average molecular (Mn) of from 500 to 15,000, or from 500 to 5000, as determined by gel permeation chromatography (GPC) using polystyrene standards.

Classes of polyols that may be used to prepare the isocyanate functional polyurethane prepolymer of the first component of the two-component composition used to prepare the particulate crosslinked polyurethane include, but are not limited to: straight or branched chain alkane polyols, e.g., 1,2-ethanediol, 1,3-propanediol, 1,2-propanediol, 1,4-butanediol, 1,3-butanediol, glycerol, neopentyl glycol, trimethylolethane, trimethylolpropane, di-trimethylolpropane, erythritol, pentaerythritol and di-pentaerythritol; polyalkylene glycols, e.g., di-, tri- and tetraethylene glycol, and di-, tri- and tetrapropylene glycol;

cyclic alkane polyols, e.g., cyclopentanediol, cyclohexanediol, cyclohexanetriol, cyclohexanedimethanol, hydroxypropylcyclohexanol and cyclohexanediethanol; aromatic polyols, e.g., dihydroxybenzene, benzenetriol, hydroxybenzyl alcohol and dihydroxytoluene; bisphenols, e.g., 4,4'-isopropylidenediphenol; 4,4'-oxybisphenol, 4,4'-dihydroxybenzophenone, 4,4'-thiobisphenol, phenolphthlalein, bis(4-hydroxyphenyl)methane, 4,4'-(1,2-ethenediyl)bisphenol and 4,4'-sulfonylbisphenol; halogenated bisphenols, e.g., 4,4'-isopropylidenebis(2,6-dibromophenol), 4,4'-isopropylidenebis(2,6-dichlorophenol) and 4,4'-isopropylidenebis(2,3,5,6-tetrachlorophenol); alkoxylated bisphenols, e.g., alkoxylated 4,4'-isopropylidenediphenol having from 1 to 70 alkoxy groups, for example, ethoxy, propoxy, α-butoxy and β-butoxy groups; and biscyclohexanols, which can be prepared by hydrogenating the corresponding bisphenols, e.g., 4,4'-isopropylidene-biscyclohexanol, 4,4'-oxybiscyclohexanol, 4,4'-thiobiscyclohexanol and bis(4-hydroxycyclohexanol)methane. Additional classes of polyols that by be used to prepare isocyanate functional polyurethane prepolymers, include for example, higher polyalkylene glycols, such as polyethylene glycols having number average molecular weights (Mn) of, for example, from 200 to 2000; and hydroxy functional polyesters, such as those formed from the reaction of diols, such as butane diol, and diacids or diesters, e.g., adipic acid or diethyl adipate, and having an Mn of, for example, from 200 to 2000. In an embodiment of the present invention, the isocyanate functional polyurethane prepolymer is prepared from a diisocyanate, e.g., toluene diisocyanate, and a polyalkylene glycol, e.g., poly(tetrahydrofuran).

The isocyanate functional polyurethane prepolymer may optionally be prepared in the presence of a catalyst. Classes of suitable catalysts include, but are not limited to, tertiary amines, such as triethylamine, and organometallic compounds, such as dibutyltin dilaurate. Additional examples of catalysts that may be used in the preparation of the isocyanate functional polyurethane prepolymer are recited below. If a catalyst is used in the preparation of the isocyanate functional polyurethane prepolymer, it is typically present in an amount of less than 5 percent by weight, preferably less than 3 percent by weight, and more preferably less than 1 percent by weight, based on the total weight of polyol and isocyanate functional monomer.

The first component of the two-component composition used to prepare the particulate crosslinked polyurethane may optionally comprise a capped isocyanate reactant having at least two capped isocyanate groups. By "capped isocyanate reactant" is meant a monomer or prepolymer having terminal and/or pendent capped isocyanate groups which can be converted, under controlled conditions, to decapped, i.e., free, isocyanate groups and separate or free capping groups. The capping groups of the capped isocyanate reactant may be fugitive or nonfugitive. By "nonfugitive capping groups" is meant a capping group, which upon decapping or deblocking from the isocyanate group, remains substantially within the forming three dimensional crosslink network, e.g., the forming three dimensional crosslink network of the particulate polymer. By "fugitive capping group" is meant a capping group, which upon decapping or deblocking from the isocyanate group, migrates substantially out of the forming three dimensional crosslink network, e.g., the forming three dimensional crosslink network of the particulate polymer.

The polyfunctional isocyanate of the capped isocyanate reactant may be selected from those classes and examples of isocyanate functional reactants as recited previously herein. Examples of nonfugitive capping groups of the capped isocyanate reactant include, but are not limited to: 1H-azoles, e.g., 1H-imidazole, 1H-pyrazole, 3,5-dimethyl-1H-pyrazole, 1H-1,2,3-triazole, 1H-1,2,3-benzotriazole, 1H-1,2,4-triazole, 1H-5-methyl-1,2,4-triazole and 1H-3-amino-1,2,4-triazole; lactams, e.g., e-caprolactam and 2-pyrolidinone; and others including, morpholine, 3-aminopropyl morpholine and N-hydroxy phthalimide. Examples of fugitive capping groups of the capped isocyanate reactant include, but are not limited to: alcohols, e.g., propanol, isopropanol, butanol, isobutanol, tert-butanol and hexanol; alkylene glycol monoalkyl ethers, such as ethylene glycol monoalkyl ethers, e.g., ethylene glycol monobutyl ether and ethylene glycol monohexyl ether, and propylene glycol monoalkyl ethers, e.g., propylene glycol monomethyl ether; and ketoximes, e.g., methyl ethyl ketoxime.

Capped isocyanate reactants may be included in the first component of the two component composition from which the particulate crosslinked polyurethane is prepared, to improve the dimensional stability of polishing pads prepared from such particulate crosslinked polyurethane. While not intending to be bound by any theory, it is believed that during polishing pad formation, the inclusion of capped isocyanate reactant in the isocyanate functional first component of the two component composition from which the particulate crosslinked polyurethane is prepared, allows for the formation of covalent bonds: (a) between at least some of the particulate crosslinked polyurethane particles; and/or (b) between the particulate crosslinked polyurethane and the crosslinked organic polymer binder. If used, the capped isocyanate reactant is typically present in an amount such that the first component (of the two component composition used to prepare the particulate crosslinked polyurethane) contains capped isocyanate groups in an amount of less than 50 mole percent, based on the total molar equivalents of free isocyanate and capped isocyanate groups, e.g., from 5 mole percent to 40 mole percent, based on the total molar equivalents of free isocyanate and capped isocyanate groups.

The active hydrogen functional reactant of the second component (ii) of the two-component composition used to prepare the particulate crosslinked polyurethane, has active hydrogen groups selected from hydroxyl, primary amine, secondary amine and combinations thereof. Polyols from which the active hydrogen functional reactant may be selected include those classes and examples of polyols recited previously herein.

Polyamine reactants that may be used to prepare the particulate crosslinked polyurethane may be selected from any of the family of ethyleneamines, e.g., ethylenediamine (EDA), diethylenetriamine (DETA), triethylenetetramine (TETA), tetraethylenepentamine (TEPA), pentaethylenehexamine (PEHA), piperazine, i.e., diethylenediamine (DEDA), and 2-amino-1-ethylpiperazine. The polyamine reactant may also be selected from one or more isomers of $C_1$–$C_3$ dialkyl toluenediamine, such as, 3,5-dimethyl-2,4-toluenediamine, 3,5-dimethyl-2,6-toluenediamine, 3,5-diethyl-2,4-toluenediamine, 3,5-diethyl-2,6-toluenediamine, 3,5-diisopropyl-2,4-toluenediamine, 3,5-diisopropyl-2,6-toluenediamine and mixtures thereof. Additional examples of polyamines from which the polyamine reactant may be selected include, but are not limited to methylene dianiline and trimethyleneglycol di(para-aminobenzoate).

A further class of polyamines that may be used to prepare the particulate crosslinked polyurethane include those based on 4,4'-methylene-bis(dialkylaniline), which may be represented by the following general formula I,

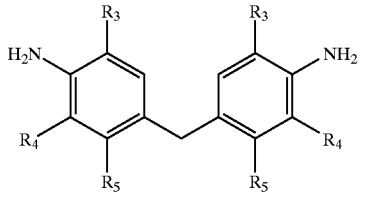

wherein $R_3$ and $R_4$ are each independently $C_1$–$C_3$ alkyl, and $R_5$ is selected from hydrogen and halogen, e.g., chlorine and bromine. Examples of polyamines based on 4,4'-methylene-bis(dialkylaniline) include, but are not limited to, 4,4'-methylene-bis(2,6-dimethylaniline), 4,4'-methylene-bis(2,6-diethylaniline), 4,4'-methylene-bis(2-ethyl-6-methylaniline), 4,4'-methylene-bis(2,6-diisopropylaniline), 4,4'-methylene-bis(2-isopropyl-6-methylaniline) and 4,4'-methylene-bis(2,6-diethyl-3-chloroaniline).

The two-component composition used to prepare the particulate crosslinked polyurethane may optionally further comprise a catalyst. Catalysts that may be used to prepare the particulate crosslinked polyurethane include, for example, tertiary amines, e.g., triethylamine, triisopropylamine and N,N-dimethylbenzylamine, and organometallic compounds, e.g., dibutyltin dilaurate, dibutyltin diacetate and stannous octoate. Additional examples of tertiary amines are listed in U.S. Pat. No. 5,693,738 at column 10 lines 6 through 38, the disclosure of which is incorporated herein by reference. Additional examples of organometallic compounds useful as catalysts are listed in U.S. Pat. No. 5,631,339 at column 4, lines 26 through 46, the disclosure of which is incorporated herein by reference. If used, catalysts are typically incorporated into the active hydrogen functional second component prior to the combination of the first and second components of the two-component composition. Catalyst levels are typically less than 5 percent by weight, preferably less than 3 percent by weight and more preferably less than 1 percent by weight, based on the total weight of the combined first and second components.

The molar equivalents ratio of isocyanate groups and optional capped isocyanate groups to active hydrogen groups of the reactants used to prepare the particulate crosslinked polyurethane is typically from 0.5:1.0 to 1.5:1.0, e.g., from 0.7:1.0 to 1.3:1.0 or from 0.8:1.0 to 1.2:1.0.

The particulate crosslinked polymer of the polishing pad may also be selected from particulate crosslinked polyepoxides. Typically, the particulate crosslinked polyepoxide is the reaction product of a two-component composition comprising, (i') an epoxide functional first component comprising an epoxide functional reactant having at least two epoxide groups; and (ii') an active hydrogen functional second component comprising an active hydrogen functional reactant having at least two active hydrogen groups that are reactive with the epoxide groups of the epoxide component.

The first and second components of the two-component composition used to prepare the particulate crosslinked polyepoxide may be mixed together and polymerized or cured to form bulk crosslinked polyepoxide, which is then ground, e.g., cryogenically ground, and optionally classified. Alternatively, the particulate crosslinked polyepoxide may be formed directly by mixing the first and second components together, pouring the mixture slowly into heated deionized water under agitation, isolating the formed particulate material, e.g., by filtration, drying the isolated particulate material, and optionally classifying the dried particulate crosslinked polyepoxide.

The epoxide functional reactant of the first component (i') of the two-component composition used to prepare the particulate crosslinked polyepoxide, may be selected from epoxide functional monomers, epoxide functional prepolymers and combinations thereof. Epoxide functional monomers that may be used include, for example: aliphatic polyepoxides, e.g., 1,2,3,4-diepoxybutane, 1,2,7,8-diepoxyoctane; cycloaliphatic polyepoxides, e.g., 1,2,4,5-diepoxycyclohane, 1,2,5,6-diepoxycyclooctane, 7-oxa-bicyclo[4.1.0]heptane-3-carboxylic acid 7-oxa-bicyclo[4.1.0]hept-3-ylmethyl ester, 1,2-epoxy-4-oxiranyl-cyclohexane and 2,3-(epoxypropyl)cyclohexane; aromatic polyepoxides, e.g., bis(4-hydroxyphenyl)methane diglycidyl ether; and mixtures thereof. Epoxide functional monomers that may be used in the present invention are typically prepared from the reaction of a polyol and an epihalohydrin, e.g., epichlorohydrin. Polyols that may be used to prepare epoxide functional monomers include those recited previously herein with regard to the preparation of the isocyanate functional prepolymer. A preferred class of epoxide functional monomers include those prepared from the reaction of a bisphenol, such as 4,4'-isopropylidenediphenol, and epichlorohydrin, e.g., 4,4'-isopropylidenediphenol diglycidyl ether.

Epoxide functional prepolymers that may be used to prepare the particulate crosslinked polyepoxide are typically prepared from the reaction of a polymeric polyol and epichlorohydrin. Classes of polymeric polyols that may be used to prepare the epoxide functional prepolymer include, but are not limited to: polyalkylene glycols, e.g., polyethylene glycol and polytetrahydrofuran; polyester polyols; polyurethane polyols; poly((meth)acrylate) polyols; and mixtures thereof. The recited classes of polymeric polyols may be prepared according to methods that are well known to the skilled artisan. In an embodiment of the present invention, the epoxide functional prepolymer is an epoxy functional poly((meth)acrylate) polymer prepared from (meth)acrylate monomers and epoxide functional radically polymerizable monomers, e.g., glycidyl (meth)acrylate. Epoxide functional prepolymers that may be used to prepare the particulate crosslinked polyepoxide may have a wide range of molecular weight, e.g., number average molecular weights of from 500 to 15,000, or from 500 to 5000, as determined by gel permeation chromatography (GPC) using polystyrene standards.

The active hydrogen functional reactant of the second component (ii') of the two-component composition used to prepare the particulate crosslinked polyepoxide may have active hydrogen groups selected from hydroxyl, carboxylic acid, primary amine, secondary amine and combinations thereof. Polyols that may be used to prepare the particulate crosslinked polyepoxide include, but are not limited to, those classes and examples of polyols recited previously herein. Examples of polyamines that may be used to prepare the particulate crosslinked polyepoxide include, but are not limited to, those classes and examples of polyamines recited previously herein.

A further class of polyamines that may be used to prepare the particulate crosslinked polyepoxide include, for example, polyamide prepolymers having at least two amine groups selected from primary amines, secondary amines and combinations thereof. Polyamide prepolymers having at least two amine groups are typically prepared from the reaction of a polyamine, e.g., diethylenetriamine, and a polycarboxylic acid, e.g., a difunctional carboxylic acid, as is known to the skilled artisan. Commercially available polyamide prepolymers from which the polyamine may be selected include VERSAMID polyamide resins, available from Cognis Corporation, Coating & Inks Division.

Suitable polycarboxylic acids from which the active hydrogen reactant (ii') may be selected include, for example, dodecanedioic acid, azelaic acid, adipic acid, 1,6-hexanedioic acid, succinic acid, pimelic acid, sebacic acid, maleic acid, citric acid, itaconic acid, aconitic acid, half-esters formed from reacting an acid anhydride with a polyol, and mixtures thereof. Also among the polycarboxylic acids which may be used are carboxylic acid group-containing polymers such as acrylic polymers, polyesters, and polyurethanes; and oligomers such as ester group-containing oligomers; as well as fatty diacids.

Carboxylic acid functional acrylic reactants may be made by copolymerizing methacrylic acid and/or acrylic acid monomers with other ethylenically unsaturated copolymerizable monomers, using techniques known to those skilled in the art. Alternatively, carboxylic acid functional acrylics may be prepared by reacting hydroxy-functional acrylic polymers with cyclic anhydrides, using conventional art-recognized techniques.

Additional polycarboxylic acid reactants include ester group-containing oligomers. Examples of ester group-containing oligomers include half-esters formed by reacting polyols and 1,2-acid cyclic anhydrides, such as the half ester formed by reacting pentaerythritol and methylhexahydrophthalic anhydride, or acid functional polyesters derived from polyols and polyacids or anhydrides.

The two-component composition used to prepare the particulate crosslinked polyepoxide may optionally comprise an epoxide ring opening catalyst. The catalyst may include those that are known to the skilled artisan, e.g., tertiary amines, such as tri-tertiarybutyl amine, and tetrafluoroboric acid. If used, the catalyst is typically added to the active hydrogen functional component (ii') prior to mixing the first and second components together. The epoxide ring opening catalyst, if used, is typically present in the two-component composition in an amount of less than 5 percent by weight, e.g., less the 3 percent or 1 percent by weight, based on the total weight of the two-component composition.

The molar equivalents ratio of epoxide groups to active hydrogen groups of the reactants used to prepare the particulate crosslinked polyepoxide is typically from 0.5:1.0 to 1.5:1.0, e.g., from 0.7:1.0 to 1.3:1.0 or from 0.8:1.0 to 1.2:1.0.

The two-component compositions from which the particulate crosslinked polyurethane and particulate crosslinked polyepoxide are each prepared may independently and optionally further comprise conventional additives. Such additives may include heat stabilizers, antioxidants, mold release agents, static dyes, pigments, flexibilizing additives, e.g., alkoxylated phenol benzoates and poly(alkylene glycol) dibenzoates, and surfactants, e.g., ethylene oxide/propylene oxide block copolymeric surfactants. If used, such additives are typically present in the two-component compositions in amounts totaling less than 10 percent by weight, preferably less than 5 percent by weight, and more preferably less than 3 percent by weight, based on the total weight of the combined first and second components. While such conventional additives may be added to either of the first or second components of the composition, they are typically incorporated into the active hydrogen functional second component to minimize the potential of adverse interactions with the isocyanate groups or epoxide groups of the respective first component.

While the particulate polymer (a) may be present in the polishing pad of the present invention in a wide range of amounts, it is typically present in a major amount. Polishing pads containing less than a major amount of particulate material (e.g., less than 51 percent by weight, based on the total weight of the particulate polymer (a) and the crosslinked polymer binder (b)), typically have an undesirably low percent pore volume, e.g., a percent pore volume of less than 2 percent by volume, based on the total volume of the pad. Correspondingly, the crosslinked polymer binder (b) is typically present in the polishing pad in a minor amount, as will be discussed in further detail herein.

The particulate polymer (a) is typically present in the polishing pad of the present invention in an amount of at least 51 percent by weight, preferably at least 65 percent by weight, and more preferably at least 75 percent by weight, based on the total weight of the particulate polymer (a) and the crosslinked polymer binder (b). Also in the present invention, the particulate polymer is typically present in the polishing pad in an amount of less than 95 percent by weight, preferably less than 90 percent by weight, and more preferably less than 85 percent by weight, based on the total weight of the particulate polymer (a) and the crosslinked polymer binder (b). Particulate polymer may be present in the polishing pad of the present invention in an amount ranging between any combination of these upper and lower amounts, inclusive of the recited values.

The polishing pad of the present invention also comprises a crosslinked organic polymer binder (b), which binds the particulate polymer together. The crosslinked polymer binder may be selected from crosslinked polyurethane binders, crosslinked polyepoxide binders and mixtures thereof. Crosslinked polyurethane binders are typically prepared from two-component compositions comprising: (i) an isocyanate functional component comprising an isocyanate functional reactant having at least two isocyanate groups, and optionally a capped isocyanate reactant having at least two capped isocyanate groups; and (ii) an active hydrogen functional second component comprising an active hydrogen functional reactant having at least two active hydrogen groups that are reactive with the isocyanate groups of the first component.

Two-component compositions that may be used to prepare the crosslinked polyurethane binder may be further described with reference to those two-component compositions used to prepare the particulate crosslinked polyurethane as discussed previously herein. Examples of isocyanate functional reactants, e.g., isocyanate functional monomers and prepolymers, capped isocyanate reactants, and active hydrogen functional reactants, e.g., polyols and polyamines, that may be used to prepare the crosslinked polyurethane binder may be selected from those classes and examples of isocyanate functional reactants, capped isocyanate reactants, and hydrogen functional reactants as described previously herein, respectively.

The capped isocyanate reactant may be included in the isocyanate functional first component of the two component composition (from which the crosslinked polyurethane binder is prepared) to delay the onset of gelation when the first and second components are combined. Delaying the onset of gelation allows more time to better mix together the particulate polymer and two component composition from which the crosslinked polyurethane binder is formed. If used, the capped isocyanate reactant is typically present in an amount such that the first component (of the two component composition used to prepare the crosslinked polyurethane binder) contains capped isocyanate groups in an amount of less than 50 mole percent, based on the total molar equivalents of free isocyanate and capped isocyanate groups, e.g., from 5 mole percent to 40 mole percent, based on the total molar equivalents of free isocyanate and capped isocyanate groups.

The two-component composition used to prepare the crosslinked polyurethane binder may optionally further comprise a catalyst. Catalysts that may be used to prepare the crosslinked polyurethane binder include classes and examples as recited previously herein with regard to the preparation of the crosslinked particulate polyurethane, such as tertiary amines, e.g., triethylamine, and organometallic compounds, e.g., dibutyltin dilaurate. If used, catalysts are typically incorporated into the active hydrogen functional second component prior to the combination of the first and second components of the two-component composition. Catalyst levels are typically less than 5 percent by weight, preferably less than 3 percent by weight and more preferably less than 1 percent by weight, based on the total weight of the combined first and second components. The molar equivalents ratio of isocyanate groups and optional capped isocyanate groups to active hydrogen groups of the reactants used to prepare the crosslinked polyurethane binder is typically from 0.5:1.0 to 1.5:1.0, e.g., from 0.7:1.0 to 1.3:1.0 or from 0.8:1.0 to 1.2:1.0.

In an embodiment of the present invention, the crosslinked polyurethane binder is the reaction production of an isocyanate functional reactant having at least two isocyanate groups, and water. The isocyanate functional reactant having at least two isocyanate groups may be selected from those classes and examples of isocyanate functional reactants recited previously herein. Preferably, when reacted with water, the isocyanate functional reactant is an isocyanate functional polyurethane prepolymer having at least two isocyanate groups. Isocyanate functional polyurethane prepolymers that may be reacted with water to form the crosslinked polyurethane binder include those described previously herein, e.g., an isocyanate functional polyurethane prepolymer that is the reaction product of toluene diisocyanate and poly(tetrahydrofuran).

While water may be mixed directly with the isocyanate functional reactant to form the crosslinked polyurethane binder, it preferably comes in contact with the isocyanate functional reactant in the form of moisture, and more preferably in the form of humidity. Typically, the particulate polymer, isocyanate functional reactant and optionally catalyst (selected from those catalysts as described previously herein with regard to the polyurethane prepolymer) are mixed together and poured into an open mold, e.g., a mold having no top or lid. The filled open mold is then placed in an oven at ambient temperature (e.g., 25° C.) or elevated temperature (e.g., from 30° C. to 90° C.) for a period of time (e.g., from 30 minutes to 24 hours) in the presence of air having a percent relative humidity of, for example, from 10 to 95 percent relative humidity.

Crosslinked polyepoxide binders are typically prepared from two-component compositions comprising: (i') an epoxide functional component comprising an epoxide functional reactant having at least two epoxide groups; and (ii') an active hydrogen functional second component comprising ad active hydrogen functional reactant having at least two active hydrogen groups that are reactive with the epoxide groups of the first component. Two-component compositions that may be used to prepare the crosslinked polyepoxide binder may be described with reference to those two-component compositions used to prepare the particulate crosslinked polyepoxide as discussed previously herein. Examples of epoxide functional reactants, e.g., epoxide functional monomers and prepolymers, and active hydrogen functional reactants (e.g., polyols, poly(carboxylic acids) and polyamines) that may be used to prepare the crosslinked polyepoxide binder may be selected from those classes and examples of epoxide functional reactants and hydrogen functional reactants as described previously herein, respectively.

The two-component composition used to prepare the crosslinked polyepoxide binder may optionally comprise an epoxide ring opening catalyst. The catalyst may include those classes and examples of epoxide catalysts recited previously herein with regard to the preparation of the particulate crosslinked polyepoxide, such as tertiary amines, e.g., tri-tertiarybutyl amine, and tetrafluoroboric acid. If used, the catalyst is typically added to the active hydrogen functional component (ii') prior to mixing the first and second components together. The epoxide ring opening catalyst, if used, is typically present in the two-component composition in an amount of less than 5 percent by weight, e.g., less the 3 percent or 1 percent by weight, based on the total weight of the two-component composition. The molar equivalents ratio of epoxide groups to active hydrogen groups of the reactants used to prepare the crosslinked polyepoxide binder is typically from 0.5:1.0 to 1.5:1.0, e.g., from 0.7:1.0 to 1.3:1.0 or 0.8:1.0 to 1.2:1.0.

The crosslinked organic polymer binder of the polishing pad may optionally further comprise conventional additives. Conventional additives that may be incorporated into the crosslinked polymer binder include those additives as described previously herein with regard to two-component compositions from which the particulate crosslinked polyurethane and particulate crosslinked polyepoxide are prepared, e.g., mold release agents, dyes and flexibilizing agents. If used, additives are typically present in the crosslinked polymer binder in amounts totaling less than 10 percent by weight, preferably less than 5 percent by weight, and more preferably less than 3 percent by weight, based on the total weight of the crosslinked polymer binder. While such conventional additives may be added to either of the first or second components of the two-component compositions from which the crosslinked polymer binder is prepared, they are typically incorporated into the active hydrogen functional second component to minimize the potential of adverse interactions with the isocyanate groups or epoxide groups of the respective first component.

The polishing pad of the present invention typically comprises a minor amount of crosslinked organic polymer binder (b). The crosslinked polymer binder is typically present in the polishing pad in an amount of at least 5 percent by weight, preferably at least 10 percent by weight, and more preferably at least 15 percent by weight, based on the total weight of the particulate polymer (a) and the crosslinked polymer binder (b). Also in the present invention, the crosslinked polymer binder is typically present in the polishing pad in an amount of less than 49 percent by weight, preferably less than 35 percent by weight, and more preferably less than 25 percent by weight, based on the total weight of the particulate polymer (a) and the crosslinked polymer binder (b). Crosslinked polymer binder may be present in the polishing pad of the present invention in an amount ranging between any combination of these upper and lower amounts, inclusive of the recited values.

The polishing pad is typically prepared by means of a multi-step process, which comprises first mixing together the particulate polymer (a) and a precursor composition of the crosslinked polymer binder (b), e.g., a two-component composition comprising an isocyanate functional first component (i) and an active hydrogen functional second component (ii). Secondly, the mixture of the particulate polymer (a) and a precursor composition of the crosslinked polymer binder (b) is polymerized or cured, e.g., by the application of heat, to form the polishing pad of the present invention.

When the particulate polymer comprises thermoplastic particulate polymer, the mixture of the particulate polymer (a) and the precursor composition of the crosslinked polymer binder (b) is polymerized or cured at a temperature that is less than the melting or sintering point of the particulate thermoplastic polymer. Heating the mixture to temperatures that are less than the melting or sintering point of the particulate thermoplastic polymer minimizes the occurrence of sintering between the thermoplastic particles of the resulting pad. When elevated temperatures are used in the preparation of the polishing pad, such elevated temperatures are typically less than 180° C. (e.g., less than or equal to 150° C., or less than or equal to 135° C.).

More typically, the mixture of particulate polymer (a) and the precursor composition of the crosslinked polymer binder (b) is polymerized in a mold with the concurrent application of pressure and heat. Upon completion of the polymerization step, the pressure underwhich the mold is held is released, the polishing pad is removed from the mold, and the pad may be further processed, e.g., cut into various shapes.

Polishing pads according to the present invention typically have one or more work surfaces, i.e., those surfaces of the pad that come into contact with the surface of the article, e.g., a silicon wafer, that is to be polished. The work surface of the polishing pad may optionally have surface features selected from, for example, channels, grooves, perforations and combinations thereof. Surface features, such as channels and grooves, can enhance the polishing or planerization efficiency of the polishing pad, particularly when the polishing pad is used in conjunction with a polishing slurry. The surface features of the work surface of the polishing pad can serve to enhance: (1) the movement of the polishing slurry between the work surface of the pad and the surface of the article that is being polished; and (2) the removal and transport of abraded material away from the surface of the article that is being polished.

Surface features, such as channels and grooves, may be introduced into the work face of the polishing pad by means that are known to those of ordinary skill in the art. The work surface of the pad may be mechanically modified, e.g., by abrading or cutting. Alternatively, surface features may be introduced into the work surface of the pad during the molding process, for example, by providing at least one interior surface of the mold with raised features that are imprinted into the work surface of the pad during its formation. Surface features may be distributed in the form of random or uniform patterns across the work surface of the polishing pad. Examples of surface feature patterns include, but are not limited to, spirals, circles, squares, cross-hatches and waffle-like patterns.

Polishing pads according to the present invention typically have a pore size of at least 1 micron, preferably at least 5 microns, and more preferably at least 10 microns. The pore size of the polishing pad is typically less than 1000 microns, preferably less than 500 microns, and more preferably less than 100 microns. The pore size of the polishing pad of the present invention may range between any combination of these upper and lower values, inclusive of the recited values.

In an embodiment of the present invention, the particulate polymer (a) and/or the crosslinked organic polymer binder (b) further comprises an abrasive particulate material. The abrasive particulate material may be distributed uniformly or non-uniformly throughout the particulate polymer and/or the crosslinked polymer binder. Typically, the abrasive particulate material is distributed substantially uniformly throughout the particulate polymer and/or the crosslinked polymer binder. If used, the abrasive particulate material is typically present in the polishing pad in amounts of less than 70 percent by weight, based on the total weight of the pad, e.g., in amounts of from 5 percent by weight to 65 percent by weight, based on the total weight of the polishing pad.

The abrasive particulate material may be in the form of individual particles, aggregates of individual particles, or a combination of individual particles and aggregates. The shape of the abrasive particulate material may be selected from, for example, spheres, rods, triangles, pyramids, cones, regular cubes, irregular cubes, and mixtures and/or combinations thereof.

The average particle size of the abrasive particulate material is generally at least 0.001 microns, typically at least 0.01 microns, and more typically at least 0.1 microns. The average particle size of the abrasive particulate material is generally less than 50 microns, typically less than 10 microns, and more typically less than 1 micron. The average particle size of the abrasive particulate material may range between any combination of these upper and lower values, inclusive of the recited values. The average particle size of the abrasive particulate material is typically measured along the longest dimension of the particle.

Examples of abrasive particulate materials that may be used in the present invention include, but are not limited to: aluminum oxide, e.g., gamma alumina, fused aluminum oxide, heat treated aluminum oxide, white fused aluminum oxide, and sol gel derived alumina; silicon carbide, e.g., green silicon carbide and black silicon carbide; titanium diboride; boron carbide; silicon nitride; tungsten carbide; titanium carbide; diamond; boron nitride, e.g., cubic boron nitride and hexagonal boron nitride; garnet; fused alumina zirconia; silica, e.g., fumed silica; iron oxide; cromia; ceria; zirconia; titania; tin oxide; manganese oxide; and mixtures thereof. Preferred abrasive particulate materials include, for example, aluminum oxide, silica, silicon carbide, zirconia and mixtures thereof.

Abrasive particulate materials used in the present invention may optionally have a surface modifier thereon. Generally, the surface modifier is selected from surfactants, coupling agents and mixtures thereof. Surfactants may be used to improve the dispersibility of the abrasive particles in the resins from which the particulate polymer (a) and/or crosslinked organic polymer binder (b) are prepared. Coupling agents may be used to better bind the abrasive particles to the matrix of the particulate polymer (a) and/or to the matrix of the crosslinked polymer binder (b) of the polishing pad. The surface modifier, if used, is typically present in an amount of less than 25 percent by weight, based on the total weight of the abrasive particulate material and surface modifier. More typically, the surface modifier is present in an amount of from 0.5 to 10 percent by weight, based on the total weight of the abrasive particulate material and surface modifier.

Classes of surfactants that may be used as surface modifiers for the abrasive particulate material include those known to skilled artisan, e.g., anionic, cationic, amphoteric and nonionic surfactants. More specific examples of surfactants that may be used include, but are not limited to, metal alkoxides, polalkylene oxides, salts of long chain fatty carboxylic acids. Art-recognized classes of coupling agents that may be optionally used to modify the surface of the abrasive particulate material include, for example, silanes, such as organosilanes, titanates and zircoaluminates.

Examples of coupling agents that may be used include, for example, SILQUEST silanes A-174 and A-1230, which are commercially available from Witco Corporation.

Polishing pads according to the present invention may have shapes selected from, for example, circles, ellipses, squares, rectangles and triangles. In an embodiment of the present invention, the polishing pad is in the form of a continuous belt. The polishing pads according to the present invention, may have a wide range of sizes. For example, circular polishing pads according to the present invention may have diameters ranging from 3.8 cm to 137 cm. The thickness of the polishing pads of the present invention may vary widely, e.g., from 0.5 mm to 5 mm.

Polishing pads according to the present invention typically have a density of from 0.5 grams per cubic centimeter (g/cc) to 1.1 g/cc. The polishing pad typically has Shore A Hardness values at least 80 (e.g., from 85 to 98), and Shore D Hardness values of at least 35 (e.g., from 40 to 70), (as determined in accordance with ASTM D 2240).

In an embodiment of the present invention, the polishing pad comprises particulate crosslinked polyurethane, and crosslinked polyurethane binder. In another embodiment of the present invention, the polishing pad comprises particulate crosslinked polyepoxide, and crosslinked polyurethane binder. In a further embodiment of the present invention, the polishing pad comprises particulate crosslinked polyepoxide, and crosslinked polyepoxide binder. In yet a further embodiment of the present invention, the polishing pad comprises particulate crosslinked polyurethane, and crosslinked polyepoxide binder. In a still further embodiment of the present invention, the polishing pad comprises particulate crosslinked polyurethane, particulate crosslinked polyepoxide, and crosslinked polyurethane binder and/or crosslinked polyepoxide binder.

Figure 3:
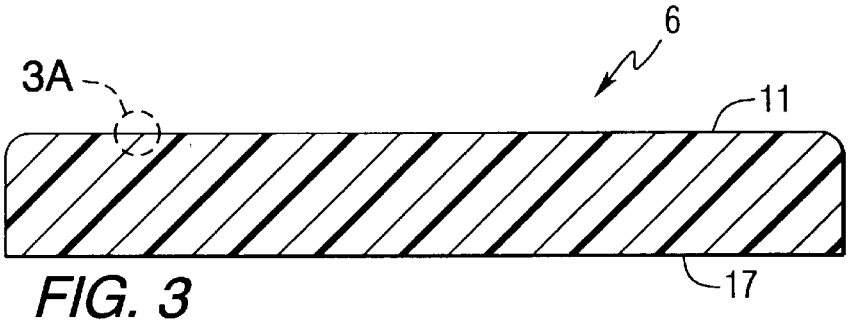
FIG. 3 is a sectional representation of a polishing pad according the present invention, in which a portion of the pad, including a portion of the work surface of the pad, is shown in greater detail.
Figure 3A:
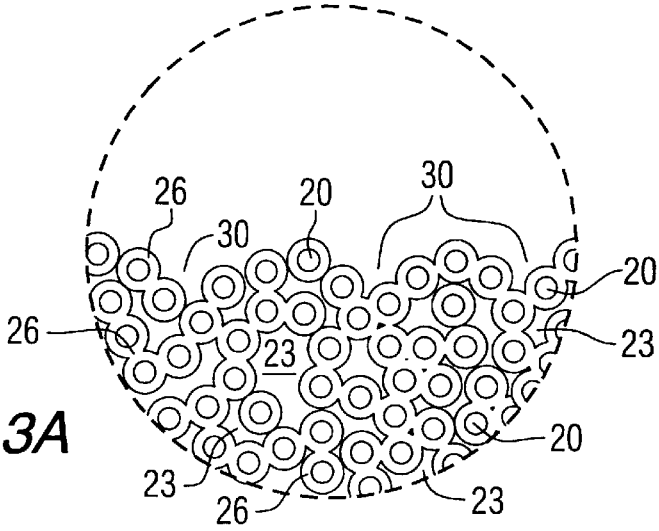

A polishing pad according to the present invention may be described with reference to drawing FIG. 3. In FIG. 3, a polishing pad 6 having a work surface 11 on one side and a substantially parallel back surface 17 on the opposite side of the pad is depicted. In FIG. 3, a portion 14 of work surface 11 is depicted in further detail in magnified view 14'. With reference to magnified view 14', polishing pad 6 comprises particulate polymer 20, which is bonded together by crosslinked polymer binder 26. Particulate polymer 20 and crosslinked polymer binder 26 together form surface pores 30 on work surface 11, and embedded pores 23, which reside below work surface 11.

While not intending to be bound by any theory, it is believed that while in use, e.g., while polishing or planarizing the surface of a silicon wafer, the porosity of the work surface of the polishing pad of the present invention remains substantially constant. With further reference to FIG. 1, as work surface 11 of polishing pad 6 is worn away during, for example a polishing or pad conditioning process, new surface pores 30 are formed as those embedded pores 23 residing proximately below work surface 11 are exposed.

Polishing pads according to the present invention may be used alone, for example being applied directly to the platen of a motorized polishing disk. More typically, the polishing pads of the present invention are used as part of a polishing pad assembly, in which at least one backing sheet is adhered to the back surface of the polishing pad. A polishing pad assembly, according to the present invention, comprises:

(a) a polishing pad (as described previously herein) having an upper work surface and a lower back surface;

(b) a backing sheet having an upper surface and a lower surface; and (c) an adhesive means interposed between and in adhesive contact with the lower back surface of said polishing pad and the upper surface of said backing sheet.

The backing sheet of the polishing pad assembly can be rigid or flexible, and typically serves the purpose of supporting or stabilizing and optionally cushioning the polishing pad during polishing operations. The backing sheet may be fabricated from materials that are known to the skilled artisan. Typically, the backing sheet is fabricated from organic polymeric materials, examples of which include, but are not limited to polyesters, e.g., polyethylene terephthalate sheet, and polyolefins, e.g., polyethylene sheet and polypropylene sheet.

Alternatively, the backing sheet of the polishing pad assembly of the present invention may be a release sheet, which can be peeled away from the adhesive means, thus allowing the pad to be adhered to another surface, e.g., the platen of a polishing apparatus, by means of the exposed adhesive means. Release sheets are known to those of ordinary skill in art and are typically fabricated from known materials, including, for example, paper or organic polymeric materials, such as polyethylene terephthalate sheet, polyolefins, e.g., polyethylene sheet and polypropylene sheet, and fluorinated polyolefins, e.g., polytetrafluoroethylene. The upper surface of the release sheet may optionally have a release coating thereon that is in contact with the adhesive means. Release coatings are well known to the skilled artisan, and may comprise, for example, fluorinated polymers and silicones.

The adhesive means of the polishing pad assembly may be selected from an adhesive assembly or an adhesive layer. An adhesive layer may be applied, as is know to the skilled artisan, to the back surface of the polishing pad and/or the upper surface of the backing sheet, prior to pressing the polishing pad and backing sheet together. The adhesive layer may be selected from contact adhesives, thermoplastic adhesives, and curable adhesives, e.g., thermosetting adhesives, as is known to the skilled artisan.

An adhesive assembly typically comprises an adhesive support sheet interposed between an upper adhesive layer and a lower adhesive layer. The upper adhesive layer of the adhesive assembly is in contact with the back surface of the polishing pad, and the lower adhesive layer is in contact with the upper surface of the backing sheet. The adhesive support sheet of the adhesive assembly is typically fabricated from an organic polymeric material, such as polyesters, e.g., polyethylene terephthalate sheet, and polyolefins, e.g., polyethylene sheet and polypropylene sheet. The upper and lower adhesive layers of the adhesive assembly may be selected from those classes of adhesives as recited previously herein with regard to the adhesive layer. Typically, the upper and lower adhesive layers are each contact adhesives. An example of a preferred adhesive assembly is generally referred to as two-sided or double coated tape, for example double coated film tapes, commercially available from 3M, Industrial Tape and Specialties Division.

Polishing pad assemblies according to the present invention, may be described with reference to FIGS. 1 and 2. The polishing pad assembly 7 of FIG. 1 includes a polishing pad 33 having an upper work surface 11 and a lower back surface 17, a backing sheet 39 having an upper surface 42 and a lower surface 45, and an adhesive layer 36 which is interposed between polishing pad 33 and backing sheet 39. Adhesive layer 36 is in adhesive contact with both lower back surface 17 of polishing pad 33, and upper surface 42 of backing sheet 39.

Figure 2:
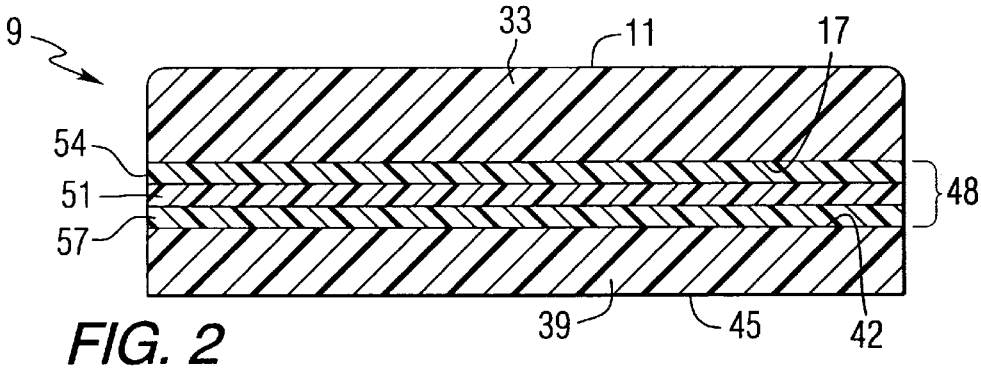
FIG. 2 is a sectional representation of a polishing pad assembly according to the present invention, which is similar to that of FIG. 1 but in which the adhesive means is an adhesive assembly.

Polishing pad assembly 9 of FIG. 2, includes an adhesive assembly 48, which is interposed between polishing pad 33 and backing sheet 39. Adhesive assembly 48 is composed of an adhesive support sheet 51, which is interposed between upper adhesive layer 54 and lower adhesive layer 57. Upper adhesive layer 54 is in contact with lower back surface 17 of polishing pad 33, and lower adhesive layer 57 is in contact with upper surface 42 of backing sheet 39. Lower surface 45 of backing sheet 39 of polishing pad assemblies 7 and 9 of FIGS. 1 and 2 may each be attached to the platen of a motorized polishing machine, not shown, by suitable means, e.g., adhesive means (not shown).

The present invention is more particularly described in the following examples, which are intended to be illustrative only, since numerous modifications and variations therein will be apparent to those skilled in the art. Unless otherwise specified, all parts and all percentages are by weight.

EXAMPLES A AND B

Preparation of Particulate Crosslinked Polymers

Example A

Particulate crosslinked polyurethane was prepared from the ingredients listed in Table A. The particulate crosslinked polyurethane was used to prepare polishing pads as described further herein in Examples 1 and 2.

TABLE A

| Ingredients | Weight (grams) |
|---|---|
| Charge 1 | |
| diamine curative (a) | 22.5 |
| diamine curative (b) | 8.8 |
| surfactant (c) | 0.1 |
| Charge 2 | |
| isocyanate functional prepolymer (d) | 68.5 |

(a) LONZACURE MCDEA diamine curative obtained from Air Products and Chemicals, Inc, which describes it as methylene bis (chlorodiethylanaline).
(b) VERSALINK P-650 poly(tetramethylene glycol) diamine curative obtained from Air Products and Chemicals, Inc.
(c) PLURONIC F108 surfactant, obtained from BASF Corporation.
(d) ARITHANE PHP-75D prepolymer, obtained from Air Products and Chemicals, Inc, which describes it as the isocyanate functional reaction product of toluene diisocyanate and poly(tetramethylene glycol).

Charge 1 was added to an open container and placed on a hot plate set at a temperature of 90° C. until the contents of the container became molten. Charge 2 was then added to the container while still on the hot plate, and the contents were thoroughly mixed with a motor driven impeller until uniform. The contents of the container were then poured slowly into 400 grams of 80° C. deionized water, with concurrently vigorous stirring of the deionized water. Upon completion of the addition of the contents of the container, vigorous mixing of the deionized water was continued for an additional 10 minutes, followed by isolation of the formed particulate crosslinked polyurethane by means of filtration. The isolated particulate crosslinked polyurethane was dried in a 130° C. oven for 2 hours.

The dried particulate crosslinked polyurethane was classified using a stack of sieves having mesh sizes from the top to the bottom of the stack of: 40 mesh (420 micron sieve openings), 50 mesh (297 micron sieve openings), 70 mesh (210 micron sieve openings) and 140 mesh (105 micron sieve openings). Particulate material was collected separately from each of the sieve screens Particulate material collected from, for example, the 70 mesh screen was determined to have a particle size range of from about 210 to 297 microns, based on the sieve opening sizes of the 50 and 70 mesh sieves.

Example B

Particulate crosslinked polyepoxide was prepared from the ingredients listed in Table B. The particulate crosslinked polyepoxide was used to prepare polishing pads as described further herein in Examples 3 and 4.

TABLE B

| Ingredients | Weight (grams) |
|---|---|
| Charge 1 | |
| polyamine curative (e) | 40.9 |
| surfactant (c) | 1.0 |
| isopropanol solvent | 15.8 |
| solvent (f) | 11.9 |
| Charge 2 | |
| epoxy resin (g) | 58.1 |

(e) VERSAMID 253 polyamine-polyamide curative, obtained from Cognis Corp.
(f) DOWANOL PM propylene glycol monomethyl ether, obtained from Dow Chemical.
(g) EPON 880 epoxy resin, obtained from Shell Chemical.

Charge 1 was added to an open container and stirred with a motor driven impeller at 60° C. until all of the components were visually observed to have dissolved and a uniform mixture was formed, followed by cooling to ambient room temperature (about 25° C.). Charge 2 was then added to the container, and the contents were further mixed until uniform. The contents of the container were then poured slowly into 300 grams of 80° C. deionized water, with concurrently vigorous stirring of the deionized water. Upon completion of the addition of the contents of the container, vigorous mixing of the deionized water was continued for an additional 2 hours, followed by isolation of the formed particulate crosslinked polyepoxide by means of filtration. The isolated particulate crosslinked polyepoxide was dried overnight in a 100° C. oven.

The dried particulate crosslinked polyepoxide was classified using a stack of sieves as described in Example A. Particulate crosslinked polyepoxide was collected separately from each of the sieve screens.

EXAMPLES 1–4

Preparation of Polishing Pads

EXAMPLE 1

A polishing pad comprising particulate crosslinked polyurethane and crosslinked polyurethane binder was prepared from the ingredients summarized in the following Table 1. Physical data of the polishing pad of Example 1 are summarized in Table 5.

TABLE 1

| Ingredients | Weight (grams) |
|---|---|
| Charge 1 | |
| particulate crosslinked polyurethane of Example A (h) | 5.2 |
| isocyanate functional prepolymer (d) | 1.23 |

TABLE 1-continued

| Ingredients | Weight (grams) |
|---|---|
| Charge 2 | |
| particulate crosslinked polyurethane of Example A | 2.0 |
| diamine curative (a) | 0.41 |
| diamine curative (b) | 0.16 |

(h) Particulate crosslinked polyurethane of Example A that was collected from the 70 mesh sieve screen of a series of sieves stacked top to bottom: 40 mesh, 50 mesh, 70 mesh and 140 mesh, and which was determined accordingly to have a particle size range of from 210 to 297 microns.

Charges 1 and 2 were each separately mixed by hand using a stainless steel spatula until homogenous. The homogenous mixtures of Charges 1 and 2 were then combined in a suitable container and mixed together by means of a motor driven impeller. A 6.5 gram portion of the combination of Charges 1 and 2 was then introduced into a 1.6 millimeter deep open circular mold having a diameter of 8.3 centimeters. The mold was closed and placed in a press under a downward force of 907 kilograms and a temperature of 135° C. for a period of 30 minutes. The mold was removed from the press and allowed to cool to ambient room temperature (about 25° C.), followed by demolding of the polishing pad from the mold.

EXAMPLE 2

A polishing pad comprising particulate crosslinked polyurethane and crosslinked polyepoxide binder was prepared from the ingredients summarized in the following Table 2. Physical data of the polishing pad of Example 2 are summarized in Table 5.

TABLE 2

| Ingredients | Weight (grams) |
|---|---|
| Charge 1 | |
| epoxy resin (g) | 1.1 |
| polyamine curative (e) | 0.74 |
| isopropanol solvent | 1.9 |
| propylene glycol monomethyl ether solvent (f) | 1.44 |
| Charge 2 | |
| particulate crosslinked polyurethane of Example A (h) | 7.2 |

Charge 1 was mixed by hand in a suitable container using a stainless steel spatula until homogenous. Charge 2 was then added to the homogenous mixture of Charge 1, followed by additional mixing by means of a motor driven impeller. A 7.2 gram portion of the combination of Charges 1 and 2 was then introduced into an open circular mold as described in Example 1. The mold was closed and placed in a press under a downward force of 907 kilograms and a temperature of 120° C. for a period of 30 minutes. The mold was removed from the press and allowed to cool to ambient room temperature (about 25° C.), followed by demolding of the polishing pad from the mold. The demolded polishing pad was then given a one hour post-cure at a temperature of 120° C.

EXAMPLE 3

A polishing pad comprising particulate crosslinked polyepoxide and crosslinked polyepoxide binder was prepared from the ingredients summarized in the following Table 3. Physical data of the polishing pad of Example 3 are summarized in Table 5.

TABLE 3

| Ingredients | Weight (grams) |
|---|---|
| Charge 1 | |
| epoxy resin (g) | 1.2 |
| polyamine curative (e) | 0.82 |
| isopropanol solvent | 2.1 |
| propylene glycol monomethyl ether solvent (f) | 1.6 |
| Charge 2 | |
| particulate crosslinked poly epoxide of Example B (i) | 7.2 |

(i) Particulate crosslinked polyepoxide of Example B that was collected from the 70 mesh sieve screen of a series of sieves stacked top to bottom: 40 mesh, 50 mesh, 70 mesh and 140 mesh, and which was determined accordingly to have a particle size range of from 210 to 297 microns.

Charge 1 was mixed by hand in a suitable container using a stainless steel spatula until homogenous. Charge 2 was then added to the homogenous mixture of Charge 1, followed by additional mixing by means of a motor driven impeller. A 7.2 gram portion of the combination of Charges 1 and 2 was then introduced into an open circular mold as described in Example 1. The mold was closed and placed in a press under a downward force of 907 kilograms and a temperature of 120° C. for a period of 30 minutes. The mold was removed from the press and allowed to cool to ambient room temperature (about 25° C.), followed by demolding of the polishing pad from the mold. The demolded polishing pad was then given a one hour post-cure at a temperature of 120° C.

EXAMPLE 4

A polishing pad comprising particulate crosslinked polyepoxide and crosslinked polyurethane binder was prepared from the ingredients summarized in the following Table 4. Physical data of the polishing pad of Example 4 are summarized in Table 5.

TABLE 4

| Ingredients | Weight (grams) |
|---|---|
| Charge 1 | |
| particulate crosslinked polyepoxide of Example B (i) | 5.0 |
| isocyanate functional prepolymer (d) | 1.5 |
| Charge 2 | |
| particulate crosslinked polyepoxide of Example B (i) | 3.3 |
| diamine curative (a) | 0.57 |
| acetone solvent | 2.0 |

Charges 1 and 2 were each separately mixed by hand using a stainless steel spatula until homogenous. The homogenous mixtures of Charges 1 and 2 were then combined in a suitable container and mixed together by means of a motor driven impeller. A 7.7 gram portion of the combination of Charges 1 and 2 was then introduced into a open circular mold as described in Example 1. The mold was closed and placed in a press under a downward force of 907 kilograms and a temperature of 120° C. for a period of 30 minutes. The mold was removed from the press and allowed to cool to ambient room temperature (about 25° C.), followed by demolding of the polishing pad from the mold. The demolded polishing pad was post-cured for one hour at a temperature of 120° C.

TABLE 5

| | Polishing Pad Physical Properties | | | |
|---|---|---|---|---|
| | Example 1 | Example 2 | Example 3 | Example 4 |
| Density ($g/cm^3$) (j) | 0.96 | 0.89 | 0.94 | 0.92 |
| Pore Volume ($cm^3/g$) (k) | 0.246 | 0.330 | 0.253 | 0.246 |
| Percent Pore Volume (l) | 23.6 | 29.4 | 23.8 | 22.6 |
| Average Pore Diameter (microns) (m) | 36 | 33 | 16 | 21 |
| Shore A Hardness (n) | 98 | 94 | 98 | 98 |
| Shore D Hardness (n) | 58 | 50 | 65 | 60 |

(j) Density was determined in accordance with American Standard Test Method (ASTM) D 1622-88.
(k) Pore volume was determined in accordance with ASTM D 4284-88, using an Autopore III mercury porosimeter from Micromeritics, and under the following conditions: a contact angle of 140°; a mercury surface tension of 480 dynes/cm; and degassing of the polishing pad sample under a vacuum of 50 micrometers of mercury.
(l) Percent pore volume was calculated from the following equation: 100x (density) × (pore volume).
(m) Average pore diameter was determined using an Autopore III mercury porosimeter from Micromeritics, under the conditions as recited previously herein with regard to the determination of pore volume.
(n) Shore A and Shore D hardness were determine in accordance with ASTM D 2240-91. Shore A hardness values in excess of 80, and Shore D hardness values in excess of 35 are considered generally to be desirable.

The present invention has been described with reference to specific details of particular embodiments thereof. It is not intended that such details be regarded as limitations upon the scope of the invention except insofar as and to the extent that they are included in the accompanying claims.

We claim:

1. A polishing pad comprising:

(a) particulate polymer selected from particulate thermoplastic polymer, particulate crosslinked polymer and mixtures thereof; and (b) crosslinked organic polymer binder, which binds said particulate polymer together, wherein said particulate polymer and said crosslinked organic polymer binder are distributed substantially uniformly throughout said pad, and said pad has a percent pore volume of from 2 percent by volume to 50 percent by volume, based on the total volume of said polishing pad.

2. The polishing pad of claim 1 wherein said particulate polymer is substantially solid.

3. The polishing pad of claim 1 wherein said particulate thermoplastic polymer is selected from polyvinylchloride, polyvinylfluoride, polyethylene, polypropylene, nylon, polycarbonate, polyester, poly(meth)acrylate, polyether, polyamide, polyurethane, polystyrene, polyimide, polysulfone and mixtures thereof.

4. The polishing pad of claim 1 wherein said particulate polymer is selected from particulate crosslinked polymer.

5. The polishing pad of claim 4 wherein said particulate polymer is selected from particulate crosslinked polyurethane, particulate crosslinked polyepoxide and mixtures thereof.

6. The polishing pad of claim 1 wherein said particulate polymer has an average particle size of from 20 microns to 500 microns.

7. The polishing pad of claim 1 wherein said crosslinked organic polymer binder (b) is selected from crosslinked polyurethane binders, crosslinked polyepoxide binders and mixtures thereof.

8. The polishing pad of claim 1 wherein said particulate polymer (a) is present in said polishing pad in a major amount, and said crosslinked organic polymer binder (b) is present in said polishing pad in a minor amount.

9. The polishing pad of claim 8 wherein said particulate polymer (a) is present in said polishing pad in an amount of from 51 percent by weight to 95 percent by weight, based on the total weight of said particulate polymer (a) and said crosslinked organic polymer binder (b); and said crosslinked organic polymer binder (b) is present in said polishing pad in an amount of from 5 percent by weight to 49 percent by weight, based on the total weight of said particulate polymer (a) and said crosslinked organic polymer binder (b).

10. The polishing pad of claim 1 wherein said polishing pad has an average pore size of from 1 to 1000 microns.

11. The polishing pad of claim 1 wherein said polishing pad has a work surface, said work surface having surface features selected from channels, grooves, perforations and combinations thereof.

12. The polishing pad of claim 1 wherein at least one of said particulate polymer (a) and said crosslinked organic polymer binder (b) further comprises an abrasive particulate material.

13. The polishing pad of claim 12 wherein said abrasive particulate material is selected from aluminum oxide, silicon carbide, titanium diboride, boron carbide, silicon nitride, tungsten carbide, titanium carbide, diamond, boron nitride, garnet, fused alumina zirconia, silica, iron oxide, cromia, ceria, zirconia, titania, tin oxide, manganese oxide and mixtures thereof.

14. A polishing pad comprising:

(a) particulate polymer selected from particulate crosslinked polyurethane, particulate crosslinked polyepoxide and mixtures thereof; and (b) crosslinked organic polymer binder selected from crosslinked polyurethane binder, crosslinked polyepoxide binder and mixtures thereof, said crosslinked organic polymer binder binding said particulate polymer together, wherein said particulate polymer and said crosslinked organic polymer binder are distributed substantially uniformly throughout said pad, and said pad has a percent pore volume of from 2 percent by volume to 50 percent by volume, based on the total volume of said polishing pad.

15. The polishing pad of claim 14 wherein said crosslinked particulate polyurethane and said crosslinked polyurethane binder are each independently the reaction product of a two-component composition comprising, (i) an isocyanate functional first component comprising an isocyanate functional reactant having at least two isocyanate groups, and a capped isocyanate reactant having at least two capped isocyanate groups; and (ii) an active hydrogen functional second component comprising an active hydrogen functional reactant having at least two active hydrogen groups that are reactive with the isocyanate groups of the isocyanate component.

16. The polishing pad of claim 15 wherein said crosslinked particulate polyepoxide and said crosslinked polyepoxide binder are each independently the reaction product of a two-component composition comprising, (i') an epoxide functional first component comprising an epoxide functional reactant having at least two epoxide groups; and (ii') an active hydrogen functional second component comprising an active hydrogen functional reactant having at least two active hydrogen groups that are reactive with the epoxide groups of the epoxide component.

17. The polishing pad of claim 16 wherein the active hydrogen functional reactant of the second component (ii) for the polyurethane polymer and binder has active hydrogen groups selected from hydroxyl, primary amine, secondary amine and mixtures thereof; and the active hydrogen functional reactant of the second component (ii') for the polyepoxide polymer and binder has active hydrogen groups selected from hydroxyl, carboxylic acid, primary amine, secondary amine and mixtures thereof.

18. The polishing pad of claim 17 wherein said particulate polymer is substantially solid, said particulate polymer has an average particle size of from 20 to 500 microns, said particulate polymer (a) is present in said polishing pad in a major amount, and said crosslinked organic polymer binder (b) is present in a minor amount.

19. The polishing pad of claim 18 wherein said particulate polymer (a) is present in said polishing pad in an amount of from 51 percent by weight to 95 percent by weight, based on the total weight of said particulate polymer (a) and said crosslinked organic polymer binder (b); and said crosslinked organic polymer binder (b) is present in said polishing pad in an amount of from 5 percent by weight to 49 percent by weight, based on the total weight of said particulate polymer (a) and said crosslinked organic polymer binder (b); and said polishing pad has an average pore size of from 1 to 1000 microns.

20. The polishing pad of claim 14 wherein said crosslinked organic polymer binder (b) is crosslinked polyurethane binder, and said crosslinked polyurethane binder is the reaction production of an isocyanate functional reactant having at least two isocyanate groups, and water.

21. The polishing pad of claim 14 wherein said polishing pad has a work surface, said work surface having surface features selected from channels, grooves, perforations and combinations thereof.

22. The polishing pad of claim 14 wherein at least one of said particulate polymer (a) and said crosslinked organic polymer binder (b) further comprises an abrasive particulate material.

23. The polishing pad of claim 22 wherein said abrasive particulate material is selected from aluminum oxide, silicon carbide, titanium diboride, boron carbide, silicon nitride, tungsten carbide, titanium carbide, diamond, boron nitride, garnet, fused alumina zirconia, silica, iron oxide, cromia, ceria, zirconia, titania, tin oxide, manganese oxide and mixtures thereof.

24. A polishing pad assembly comprising:

(a) a polishing pad having an upper work surface and a lower back surface;

(b) a backing sheet having an upper surface and a lower surface; and (c) an adhesive means interposed between and in adhesive contact with the lower back surface of said polishing pad and the upper surface of said backing sheet, wherein said polishing pad (a) comprises, (i) particulate polymer selected from particulate thermoplastic polymer, particulate crosslinked polymer and mixtures thereof; and (ii) crosslinked organic polymer binder, which binds said particulate polymer together, wherein said particulate polymer and said crosslinked organic polymer binder are distributed substantially uniformly throughout said polishing pad, and said polishing pad has a percent pore volume of from 2 percent by volume to 50 percent by volume, based on the total volume of said polishing pad.

25. The polishing pad assembly of claim 24 wherein said adhesive means is selected from: an adhesive assembly comprising, an upper adhesive layer in contact with the back surface of said polishing pad, a lower adhesive layer in contact with the upper surface of said backing sheet, and an adhesive support sheet interposed between said upper and lower adhesive layers; and an adhesive layer.

26. The polishing pad assembly of claim 24 wherein the particulate polymer of said polishing pad is selected from particulate crosslinked polyurethane, particulate crosslinked polyepoxide and mixtures thereof; and the crosslinked organic polymer binder of said polishing pad is selected from crosslinked polyurethane binder, crosslinked polyepoxide binder and mixtures thereof.

27. The polishing pad of claim 14 wherein said crosslinked particulate polyurethane and said crosslinked polyurethane binder are each independently the reaction product of a two-component composition comprising, (i) an isocyanate functional first component comprising an isocyanate functional reactant having at least two isocyanate groups; and (ii) an active hydrogen functional second component comprising an active hydrogen functional reactant having at least two active hydrogen groups that are reactive with the isocyanate groups of the isocyanate component.

* * * * *

UNITED STATES PATENT AND TRADEMARK OFFICE

CERTIFICATE OF CORRECTION

PATENT NO. : 6,477,926 B1
DATED : November 12, 2002
INVENTOR(S) : R. G. Swisher et al.

It is certified that error appears in the above-identified patent and that said Letters Patent is hereby corrected as shown below:

Column 26,
Line 23, after "from", add -- a group consisting of --.

Signed and Sealed this

Tenth Day of June, 2003

JAMES E. ROGAN
*Director of the United States Patent and Trademark Office*